US006308851B1

(12) United States Patent
Welschoff

(10) Patent No.: US 6,308,851 B1
(45) Date of Patent: Oct. 30, 2001

(54) USE-EVIDENCING SMOKE FILTER CONTAINER SYSTEM

(75) Inventor: Heinz Welschoff, Ft. Lauderdale, FL (US)

(73) Assignee: SmokeSafe Corporation, North Palm Beach, FL (US)

( * ) Notice: Subject to any disclaimer, the term of this patent is extended or adjusted under 35 U.S.C. 154(b) by 0 days.

(21) Appl. No.: 09/227,779

(22) Filed: Jan. 8, 1999

Related U.S. Application Data

(63) Continuation-in-part of application No. 08/652,664, filed on May 28, 1996, now Pat. No. 5,964,218.

(51) Int. Cl.[7] ..... A62B 7/10; A62B 23/02; B65D 55/02

(52) U.S. Cl. ..... 220/253; 220/265; 220/266; 222/153.06; 128/206.07

(58) Field of Search ..... 220/253, 266, 220/265; 215/250, 252, 253; 222/153.05, 153.06, 153.14, 565, 548; 128/206.17

(56) References Cited

U.S. PATENT DOCUMENTS 4,541,541 * 9/1985 Hickman et al. ..... 220/253
4,613,063 * 9/1986 Wright ..... 222/153.06
4,934,361 * 6/1990 Michel et al. .
5,303,850 * 4/1994 Connan ..... 222/153.06
5,449,085 * 9/1995 Brun, Jr. ..... 220/253
5,524,616 * 6/1996 Smith et al. .
5,562,092 * 10/1996 George .
5,964,218 * 10/1999 Smith et al. .

* cited by examiner

*Primary Examiner*—Nathan J. Newhouse
(74) *Attorney, Agent, or Firm*—Akerman Senterfitt

(57) ABSTRACT

A use-evident container for containing an object and selectively preventing elements outside said container to reach the object comprises two housing portions and two caps. The two housing portions define a chamber for surrounding an object. The housing portions each define at least one opening forming a first part of a fluid flow path between the chamber and outside of the housing. The caps close the at least one opening and have at least one cap hole forming a second part of the fluid flow path when the at least one opening and the at least one cap hole at least partially overlap one another. At least one cap connector rotatably connects the housing portions and the cap and enables the fluid flow path to be opened and closed by relative rotation of the housing portion and the cap. At least one single-use lock engages the housing portion and the cap and prevents the relative rotation. The lock holds the housing and the cap in a first relative position in which the fluid flow path is closed. The fluid flow path is openable only by the relative rotation to a second relative position and the relative rotation being possible only upon an unlocking of the single-use lock. The single-use lock thereafter permanently evidences the unlocking.

13 Claims, 3 Drawing Sheets

USE-EVIDENCING SMOKE FILTER CONTAINER SYSTEM

CROSS-REFERENCE TO RELATED APPLICATION

This is a continuation-in-part of application Ser. No. 08/652,664, filed May 28, 1996, now U.S. Pat. No. 5,964, 218.

STATEMENT REGARDING FEDERALLY SPONSORED RESEARCH AND DEVELOPMENT

Not Applicable

FIELD OF THE INVENTION

This invention relates to fire fighting safety equipment. More specifically, the invention relates to novel features on a filter container to indicate that the filter container has been opened and used.

BACKGROUND OF THE INVENTION

Breathing masks are often worn by workers in hazardous environments. One type of such a mask extends only over a user's nose and mouth, and contains a charcoal filter through which the air being breathed passes. The filter removes particles and toxic gases from the air. However, use of this type of breathing apparatus is typically prohibited by most fire departments as being inadequate, unreliable or unsafe in many environments where fire and smoke are present.

Instead, fire fighters are commonly approved to use safer self-contained breathing equipment when entering burning buildings. Such equipment includes a tank of compressed air and a pressure regulator to supply air at a constant pressure that can be tolerated by the fire fighter. A hose connects the air regulator to a full-face mask that is worn over the fire fighter's face. The mask includes an outlet for air exhaled by the fire fighter and a transparent visor. When worn by the user, the mask not only provides a sealed volume of breathable air over the user's face, but also protects the fire fighter's eyes from the smoke. Self-contained breathing apparatus with a full-face mask typically is the only type of smoke inhalation prevention equipment that is authorized by a fire department.

The tank of the fire fighter's breathing equipment has a finite supply of air. Although warning mechanisms are provided to alert the fire fighter when the supply of air is running low, there always is the possibility that the fire fighter will not be able to exit the burning structure before the exhaustion of the air supply. There is also a possibility that a fire fighter may become trapped within a burning structure, due to structure collapse, for example. The fire fighter may become lost in a large smoke-filled area, such as a shopping mall. The fire fighter could also be injured or incapacitated in someway and rendered immobile. In these instances, the fire fighter can run out of breathable air and be in imminent danger of death. As a consequence, it is desirable to provide an alternative breathing apparatus that protects against smoke inhalation for use in such imminent life-threatening emergencies.

Although a charcoal filter-type mouth filter could be provided to fire fighters for emergency back-up to authorized self-contained breathing apparatus, fire department officials are often concerned that such masks will be used routinely in the normal course of fire fighting and not reserved for imminent death situations, and therefore prohibit their use outright. Accordingly, it is desirable to provide a way of issuing back-up breathing devices to fire fighters in a manner which restricts their use to true emergency imminent death situations. It is also desirable to provide a mechanism by which fire fighters can quickly identify previous use and fire department officials can detect the unauthorized use of such emergency breathing devices.

BRIEF SUMMARY OF THE INVENTION

An object of the present invention is to provide a use-evidencing container for use in an emergency breathing situation which provides a clear indication that the apparatus has been used.

A further object of the invention is to provide an apparatus for storing the emergency device in a durable and moisture resistant manner for long term dormancy.

These and other objects of the invention are achieved by the subject device which comprises two housing portions and two caps. The two housing portions define a chamber for surrounding an object such as a filter. The housing portions each define at least one opening which forms a first part of a fluid flow path between the chamber and outside of the housing. A cap closes the opening and has at least one cap hole which forms a second part of the fluid flow path when the opening and the at least one cap hole partially overlap one another. At least one cap connector rotatably connects the housing portions and the cap and enables the fluid flow path to be opened and closed by relative rotation of the housing portion and the cap. At least one single-use lock engages the housing portion and the cap and prevents the relative rotation. The lock holds the housing and the cap in a closed position in which the fluid flow path is closed. The fluid flow path is openable only by the relative rotation to an open position and the relative rotation being possible only upon an unlocking of the single-use lock. The single-use lock thereafter permanently evidences the unlocking.

The housing portions can be optionally formed separate from one another. In such a situation, the container further comprises a housing connector joining the first and second housing portions. The housing connector also prevents the first housing portion from rotating relative to the second housing. One embodiment of a housing connector is a circular lip positioned on the first housing portion and a circular recess positioned on the second housing portion. The circular recess is shaped to receive the circular lip and to prevent the circular lip from being removed from the circular recess.

One embodiment of a single-use is a pin extending from a housing portion and a pin receiver adapted to receive the pin positioned on a respective cap. Torque applied to the housing portion relative to the respective cap releases the single-use lock by breaking either the pin or the pin receiver. The breaking of the pin or the pin receiver prevents the single-use lock from being engaged and evidences releasing of the single-use lock.

The use-evident container can optionally include a conduit connector attached to a cap. The conduit connector is adapted for accepting a conduit. Also, the conduit can communicate with the chamber when the cap is rotated to be in the open position. The use-evident container can also optionally include a rotational stop. The rotational stop orients the housing portion and the respective cap in the open position after the lock is released. A center connector positioned substantially adjacent a center point of the housing portion and the respective cap can also be included. The center connector rotably connects the housing portion with the cap and prevents and helps to prevent fluid communication between the outside and the chamber.

BRIEF DESCRIPTION OF THE DRAWINGS

There are shown in the drawings embodiments of the invention that are presently preferred, it being understood, however, that the invention is not limited to the precise arrangements and instrumentalities shown, wherein.

DETAILED DESCRIPTION OF THE INVENTION

Figure 1:
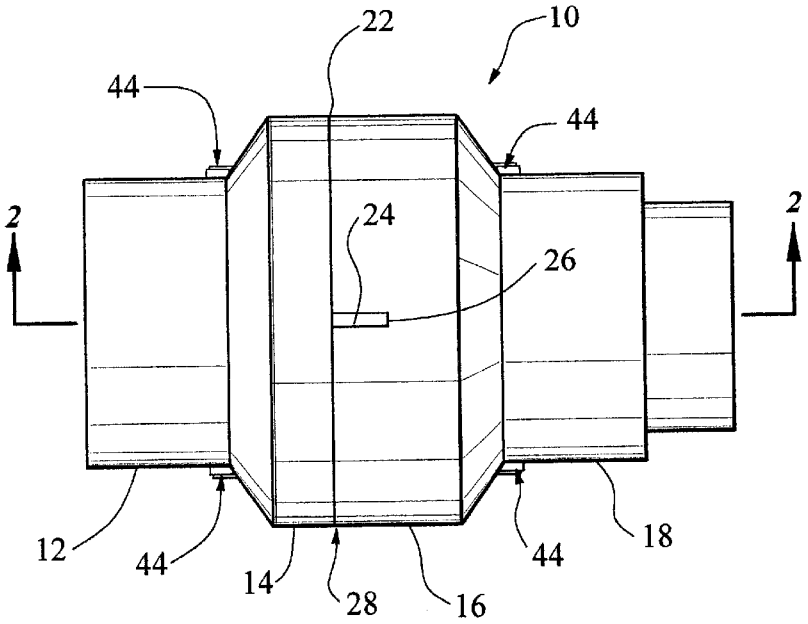
FIG. 1 shows a side view of the use-evident container according to the present invention.
Figure 2:
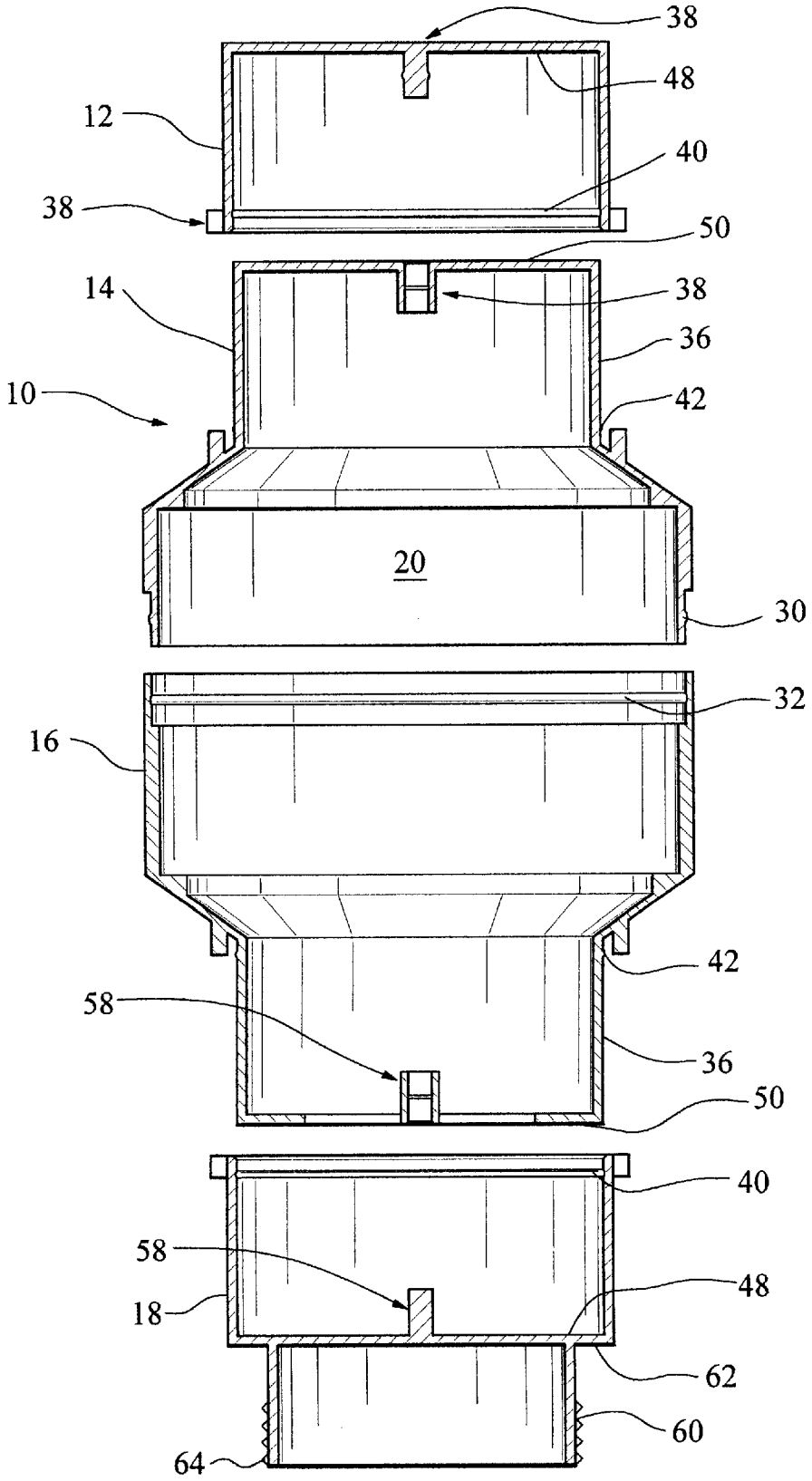
FIG. 2 is an exploded cross-section of the use-evident container taken along the line 2—2 in FIG. 1.

Referring to FIGS. 1 and 2, a use-evident container is shown according to the invention. The use-evident container 10 comprises a first cap 12, a first housing 14, a second housing 16, and a second cap 18. The first housing 14 and the second housing 16 combine to define a chamber 20 to house an object, not shown. The first and second housings 14, 16 can either be one-piece or separate; however, the presently preferred first and second housings 14, 16 are separate to facilitate the ease of placing an object within the chamber 20.

Any type of object can be protected with the use-evident container 10; however, the presently preferred object is a filter. The use-evident container 10 is also not limited as to the type, shape, or size of filter that can be housed within the chamber 20, and the filter may or may not completely fill the chamber 20. The chamber 20 can also be filled either with a pre-formed filter, with loose filter particles, or a combination of both. The presently preferred filter is composed of fibers that are pre-formed in the form of a disc that fits within the chamber 20.

The presently preferred separate first a and second housings 14, 16 are connected using a housing connector 28 along a seal 22. Any type of housing connector 28 used to connect the first and second housings 14, 16 is acceptable. Although not necessary, the housing connector 28 preferably forms an air and water tight seal 22 between the first and second housings 14, 16. This feature is particularly useful when the object contained within the chamber 20 is either air and/or water sensitive.

The housing connector 28 preferably prevents the two housings 14 and 16 from being subsequently disconnected. Preventing the two housings 14 and 16 from being subsequently disconnected advantageously prevents material outside of the container 10 from undesirably entering the chamber 20 and contaminating the filter. Such types of housing connectors 28 are well known in the art and any that are capable of performing that function are acceptable. The presently preferred housing connector 28 is lip 30 on one of the two housings 14 or 16 that is adapted to be received in a recess 32 in the other housing 16 or 14. Advantageously, this type of housing connector 28 can also be an air and water tight the advantages of which have been previously discussed.

The invention is not limited as to whether the housing connector 28 can enable the first housing 14 and the second housing 16 to rotate relative to one another. However, the first and second housings 14, 16 are preferably stationary relative to one another. Features capable of preventing rotation of the first housing 14 relative to the second housing 16 are well known in the art and all are acceptable. For example, the first housing 14 could be sized so as to press fit onto the second housing 16 such that the friction of the connection between the housings 14, 16 prevents rotation.

The presently preferred combination of features to prevent rotation is a key 24 extending from either housing 14 or 16 and a slot 26 formed in the other housing 16 or 14 to accept the key 24. When the two housings 14 and 16 are connected, the slot 26 accepts the key 24 and prevents rotation of the housings 14 and 16 relative to one another. The advantage of preventing the housings 14 and 16 from rotating relative to each other will be discussed later in the specification.

Figure 3A:
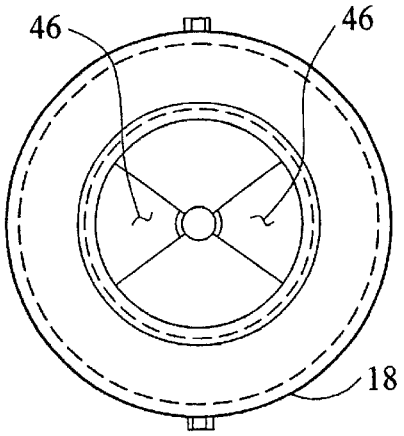
FIG. 3A is an end view of a cap.
Figure 3B:
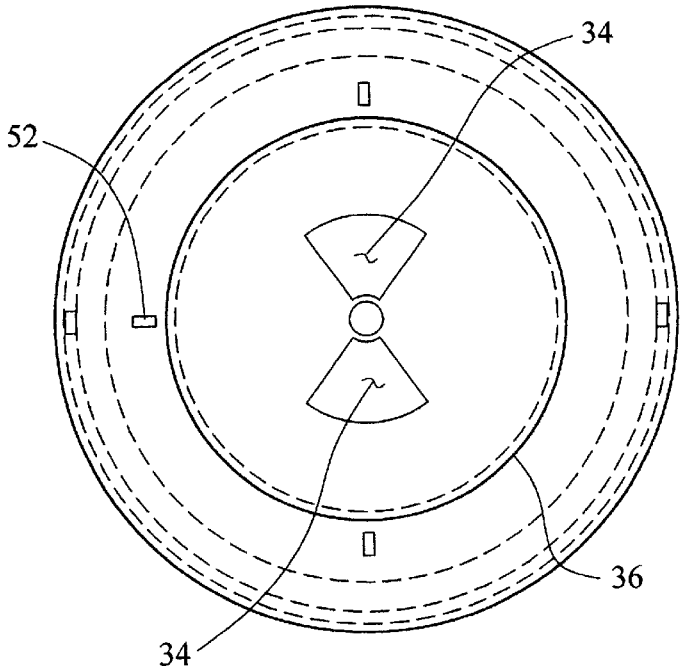
FIG. 3B is an end view of a housing.

Each housing 14, 16 contains at least one opening 34. Openings 34 on both housings 14 and 16 are defined by cap receivers 36 extending from the housings 14, 16. The cap receivers 36 are adapted for receiving the first and second caps 12, 18. Although any number, size, and orientation of openings 34 can be used with this invention, the presently preferred openings 34 are a pair of opposing arcs as illustrated in FIG. 3B.

Each cap 12, 18 is connected to the cap receivers 36 using a cap connector 38. Any type of cap connector 38 is acceptable that can be used to connect a cap 12, 18 to a cap receiver 36 and to allow the cap 12, 18 to rotate relative to the cap receiver 36. The presently preferred cap connector 38 allows the cap receiver 36 and cap 12, 18 to be initially connected but prevents the cap receiver 36 and cap 12, 18 from being subsequently disconnected. Preventing the cap receiver 36 and cap 12, 18 from being subsequently disconnected advantageously prevents material outside of the container 10 from undesirably entering the chamber 20 and possibly contaminating the filter. The presently preferred cap connector 38 is also air and water proof. As illustrated in FIG. 2, the presently preferred cap connector 38 is a circular lip 42 on either the cap receiver 36 or cap 12, 18 and a circular recess 40 on the other feature. The circular recess 40 is adapted to receive the circular lip 42. Advantageously, this type of housing connector 28 can also provide an air and water tight seal between the caps 12, 18 and the cap receivers 36.

Between the cap receiver 36 and each caps 12, 18 is at least one singe-use lock 44. The lock 44 guides the cap 12, 18 onto the cap receiver 36 in a particular rotational orientation. The lock 44 also prevents rotation of the caps 12, 18 relative to the cap receiver 36. However, once the lock 44 releases, the lock allows the cap 12, 18 to rotate relative to the cap receiver 36.

Each cap 12, 18 includes cap holes 46. Although any number, size, and orientation of cap holes 46 can be used with this invention, the presently preferred cap holes 46 are a pair of opposing arcs as illustrated in FIG. 3A. When the cap 12, 18 is first connected to the cap receiver 36, the lock 44 orients the cap holes 46 of the cap 12, 18 so that the cap holes 46 do not overlap the openings 34 in the housing 14, 16 being covered by the cap 12, 18. This positioning of the cap 12, 18 relative to the housing 14, 16 is defined as the "closed position". The inside cap surface 48 is preferably flush to the outside cap connector surface 50, so that in the closed position, the caps 12, 18 and the cap receivers 36 form air and water tight seals.

Once the lock 44 is released, the cap 12, 18 can rotate relative to the cap receiver 36 such that the cap holes 46 of the cap 12, 18 and the openings 34 of the cap receivers 36 can at least partially overlap and form a fluid path from outside of the housing 10 into the chamber 20. This position is defined as the "open position".

When the lock 44 is released, a rotational stop 52 can be included that prevents the cap 12, 18 from rotating relative to the cap receiver 36 past a particular rotational orientation. The rotational stop 52 is preferably situated such that rotation is prevented at a position which allows the greatest amount of flow through the fluid path. This feature is particularly useful in aiding an user of the use-evident container 10 to release the lock 44 and to quickly orient the cap 12, 18 relative to the cap receiver 36 to obtain the greatest flow into the chamber 20.

Once the lock 44 is released, the presently preferred lock 44 cannot be further engaged. Thus, once the lock is released, the lock 44 will always be released. This particular feature evidences that the container 10 has been opened and thus has been used. This use-evidencing is particular important when the object, such as a filter, contained within the chamber 20 cannot be reused.

Figure 4A:
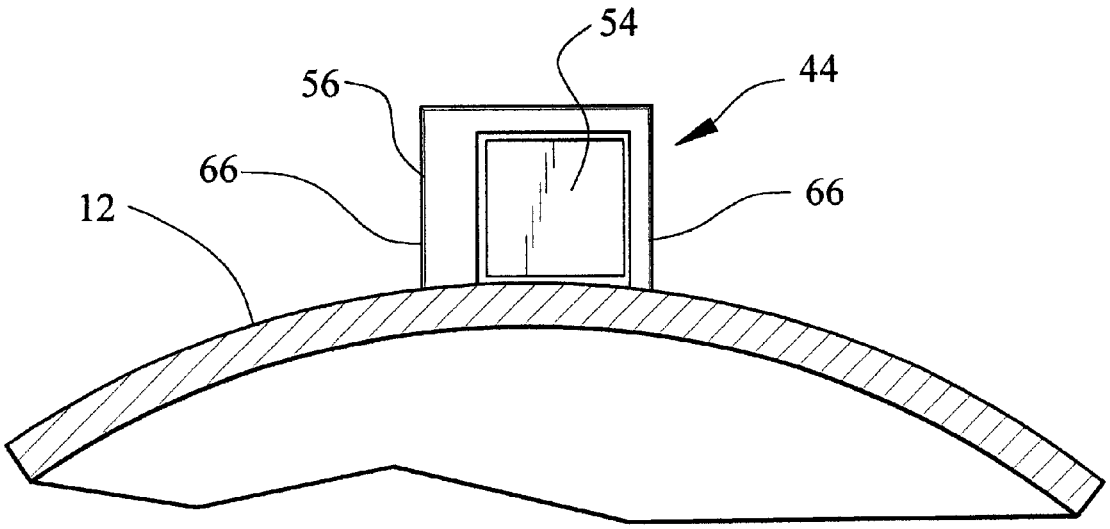
FIG. 4A is a close up front view of a lock.
Figure 4B:
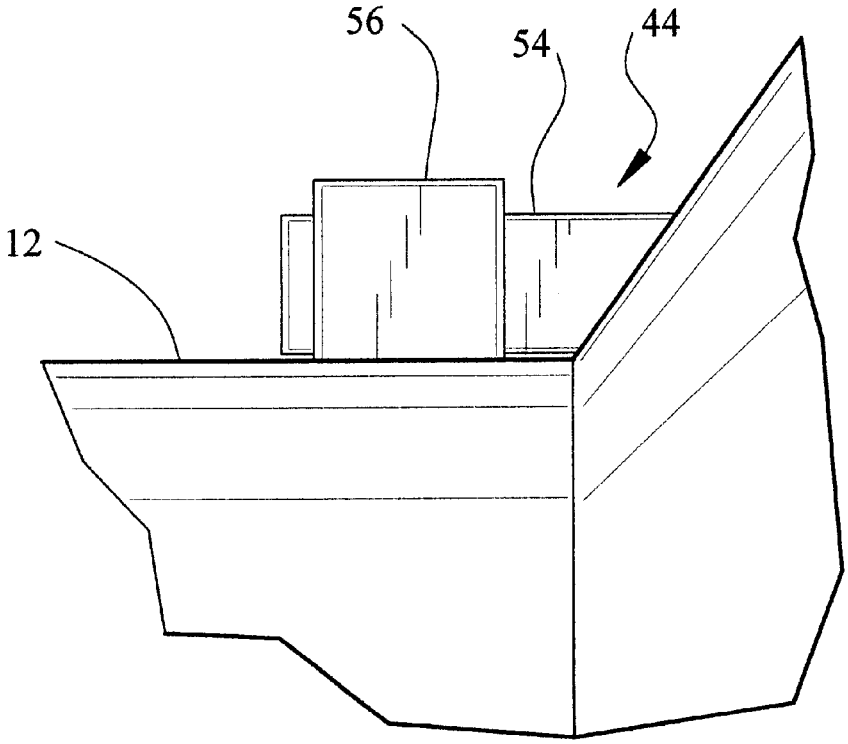
FIG. 4B is a close up side view of the lock shown in FIG. 4A.

Although any type of lock 44 that includes the above identified limitations can be used with this invention, the presently preferred lock 44 is illustrated in FIGS. 4A and 4B and includes a pin 54 located on either of the cap 12, 18 or cap receiver 36, and a pin receiver 56 located on the opposite feature. The presently preferred pin receiver 56 is U-shaped so as to circumferentially surround the pin 54 at a particular radial cross-section. Once the pin 54 is located within the pin receiver 56, the cap 12, 18 cannot rotate relative to the cap receiver 36. However, once a certain amount of torque has been exerted on the cap 12, 18 relative to the cap receiver 36, either the pin 54 or pin receiver 56 breaks so as to enable the cap 12, 18 to rotate relative to the cap receiver 36. Because either the pin 54 or pin receiver 56 breaks as a result of the "opening" (placing in the open position) of the container 10, the container 10 becomes use-evident.

Although the lock 44 can be released in any manner, the presently preferred lock 44 uses torque applied to the cap 12, 18 relative to the housing 14, 16 to release the lock 44. The presently preferred lock 44 is not limited as to the amount of torque needed to release the lock 44. However, the presently preferred amount of torque is that which can be exerted by an average human being twisting the cap 12, 18 relative to the cap receiver 36. This amount of torque can be predetermined by using a particular configuration of the lock 44. For example, with the presently preferred lock 44, the amount of torque is determined by the type of material used for the pin 54 and/or pin receiver 56 and the thickness of the pin 54 and/or thickness of the legs 66 of the pin receiver 56 such that the weakest material/thickness combination of either the pin 54 or pin receiver 56 determines the amount of torque needed to release the lock 44.

Although any rotational stop 52 is acceptable that can prevent rotation of the cap 12, 18 relative to the cap receiver 36 at a particular rotational orientation, the presently preferred rotational stop 52 to be used with the presently preferred lock 44 is a bar 52. The bar 52 extends from either the cap 12, 18 or the cap receiver 36 and is positioned so as to abut either the pin 54 or pin receiver 56 at a desired rotational orientation and to prevent further rotation in at least one direction.

The cap 12, 18 and cap receiver 36 can also include a center connector 58 located substantially in the center of the cap 12, 18 and cap receiver 36. The center connector 58 can be in place of the cap connector 38 or can be in addition to the cap connector 38. The limitations as to the cap connector 38 also apply to the center connector 58. The center connector 58 can be advantageously used to pull the inside cap surface 48 flush to the outside cap connector surface 50. Such a flush connection can enable the cap 12, 18 and cap connector 38 to be air and water tight when in a closed position.

The caps 12, 18 can also include conduit connectors 60. The presently preferred conduit connector extends from the outside cap surface 62 and surrounds the cap holes 46. The conduit connectors 60 are adapted to accept any type of conduit, not shown, that can be used to convey a fluid to the cap holes 46. Conduit connectors 60 are well known in the art and all are acceptable for this purpose. The presently preferred conduit connectors 60 use threads 64 around the outside diameter of the conduit connectors 60 to accept a conduit.

Although the caps 12, 18 can be similar and the first housing 14 is very similar to the second housing, aside from the aforementioned limitations, these features can vary substantially from one another. These variations can include variations in size, in shape, or in number of openings 34 or holes 46 with these example variations only intended to be illustrative and not limiting. An example why the two housings 14, 16 can differ is that the filter could be non-symmetrical. An example why the caps 12, 18 can vary is that the conduits going to a given caps 12, 18 can vary in size.

When the use-evident container 10 is first assembled and an object is within the chamber, the container 10 is in the closed position. To change the use-evident container to the open position, the following presently preferred procedure can be used. Each cap of 12, 18 the container 10 is to be held by one hand. Once so held, the user twists the caps 12, 18 relative to each other. Because the housings 14, 16 of the presently preferred container 10 do not rotate relative to each other, this twisting action will apply a torque to and release the lock or locks 44 between the first cap 12 and first housing 14 and the lock or locks 44 between the second cap 18 and the second housing 16. The twisting action continues until rotation is stopped by the rotational stops 52. When the rotation is stopped, the container 10 is in the open position and any fluid outside the container 10 capable of flowing through the conduits can enter into the chamber 20 via the flow paths passing through the first and second housings 14, 16. Because the locks 44 are single-use-evident, the current user or subsequent inspector of the container 10 can easily determine whether the container 20 has been used.

What is claimed is:

1. A use-evident container for containing an object and selectively preventing elements outside said container to reach the object, comprising:

a housing defining a chamber surrounding the object, said housing having at least one housing portion, said housing portion defining at least one opening for fluidly communicating said chamber with the outside, said housing portion having a respective cap covering said at least one opening, said respective cap defining at least one cap hole;

at least one cap connector for rotably connecting said housing portion with said respective cap; and, at least one single-use lock in an engaged state engaging said housing portion and said respective cap for preventing rotation of said housing portion relative and orienting said housing portion and said respective cap in a first position in which said at least one cap hole is prevented from overlapping said at least one opening and prevents fluid communication between the outside and said chamber, said lock in a released state allows rotation to an open position of said housing portion relative to said respective cap in which said at least one cap hole overlaps said at least one opening and allows fluid communication between the outside and said chamber, said lock changing from said engaged state to said released state by an unlocking of said lock, said single-use lock thereafter permanently evidencing said unlocking, wherein said housing has a first housing portion formed separate from a second housing portion, further comprising a housing connector for joining said first and second housing portions and preventing said first housing portion from rotating relative to said second housing.

2. The use-evident container of claim 1, wherein said housing connector includes a circular lip positioned on said first housing portion and a circular recess positioned on said second housing portion, said circular recess is shaped to receive said circular lip and to prevent said circular lip from being removed from said circular recess.

3. The use-evident container of claim 1, wherein said single-use lock includes a pin extending from said housing portion and a pin receiver adapted to receive said pin positioned on said respective cap.

4. The use-evident container of claim 3, wherein torque applied to said housing portion relative to said respective cap releases said single-use lock by breaking either said pin or said pin receiver, said breaking of said pin or said pin receiver prevents said single-use lock from being engaged and evidences releasing of said single-use lock.

5. The use-evident container of claim 1, further comprising a conduit connector attached to said at least one cap for accepting a conduit and for communicating the conduit with said chamber in said open position.

6. The use-evident container of claim 1, further comprising a rotational stop for orienting said housing portion and said respective cap in said open position after said lock is released.

7. The use-evident container of claim 1, further comprising a center connector positioned substantially adjacent a center point of said housing portion and said respective cap for rotably connecting said housing portion with said respective cap and preventing fluid communication between the outside and said chamber.

8. A use-evident container, comprising:

a housing defining a chamber for surrounding an object, said housing having at least one opening forming a first part of a fluid flow path between said chamber and outside of said housing;

a cap having a portion for closing said at least one opening and at least one further opening forming a second part of said fluid flow path when said at least one opening and said at least one further opening at least partially overlap one another;

at least one cap connector for rotatably connecting said housing and said cap and enabling said fluid flow path to be opened and closed by relative rotation of said housing and said cap; and, at least one single-use lock engaging said housing and said cap for preventing said relative rotation, said lock holding said housing and said cap in a first relative position in which said fluid flow path is closed, said fluid flow path being openable only by said relative rotation to a second relative position and said relative rotation being possible only upon an unlocking of said single-use lock, said single-use lock thereafter permanently evidencing said unlocking, further comprising:

said housing having at least two openings forming parts of a fluid flow path through and including said chamber, between respective locations outside of said housing;

respective caps, each having a portion for closing respective ones of said at least two openings and each having at least one of said further openings forming parts of said fluid path when said each of said at least two openings and each of said at least one further openings at least partially and respectively overlap one another;

respective cap connectors for rotatably connecting said housing and each of said respective caps and enabling said parts of said fluid flow path to be opened and closed by relative rotation of said housing and said respective caps; and, respective single-use locks engaging said housing and said respective caps for preventing said relative rotation, said respective locks holding each of said housing and said caps in a first relative position in which said parts of said fluid flow path is closed, said parts of said flow path being openable only by said relative rotation to a second relative position and said relative rotation being possible only upon an unlocking of said single-use lock, said single-use lock thereafter permanently evidencing said unlocking.

9. The use-evident container of claim 8, wherein said single-use lock includes a pin extending from said housing and a pin receiver adapted to receive said pin positioned on said respective cap.

10. The use-evident container of claim 9, wherein torque applied to said housing relative to said respective cap releases said single-use lock by breaking either said pin or said pin receiver, said breaking of said pin or said pin receiver prevents said single-use lock from being engaged and evidences releasing of said single-use lock.

11. The use-evident container of claim 8, further comprising a conduit connector attached to said respective cap for accepting a conduit and for forming a third part of said fluid flow path between said chamber and outside of said housing.

12. The use-evident container of claim 8, further comprising a rotational stop for orienting said housing and said respective cap in said second relative position after said lock is released.

13. The use-evident container of claim 8, further comprising a center connector positioned substantially adjacent a center point of said respective cap for rotably connecting said housing with said respective cap.

* * * * *